US007184695B2

(12) United States Patent
Furuya

(10) Patent No.: US 7,184,695 B2
(45) Date of Patent: Feb. 27, 2007

(54) IMAGE FORMING APPARATUS AND ELASTIC ROLLER

(75) Inventor: Satoru Furuya, Tokyo (JP)

(73) Assignee: Oki Data Corporation, Tokyo (JP)

( * ) Notice: Subject to any disclaimer, the term of this patent is extended or adjusted under 35 U.S.C. 154(b) by 282 days.

(21) Appl. No.: 10/871,323

(22) Filed: Jun. 18, 2004

(65) Prior Publication Data

US 2004/0258438 A1 Dec. 23, 2004

(30) Foreign Application Priority Data

Jun. 18, 2003 (JP) ..... 2003-172850

(51) Int. Cl.
*G03G 15/16* (2006.01)

(52) U.S. Cl. ..... 399/313

(58) Field of Classification Search ..... 399/313, 399/314, 297

See application file for complete search history.

(56) References Cited

U.S. PATENT DOCUMENTS 5,572,304 A * 11/1996 Seto et al. ..... 399/313

FOREIGN PATENT DOCUMENTS

JP 09-212012 A 8/1997
JP 11-231610 A 8/1999

* cited by examiner

*Primary Examiner*—Susan Lee
(74) *Attorney, Agent, or Firm*—Akin Gump Strauss Hauer & Feld, LLP

(57) ABSTRACT

A developing agent image is formed by adhering a developing agent onto an electrostatic latent image formed on an image holding material and transferred onto an image forming medium, thereby forming an image. A resistance value ratio of a resistance value of a transfer member arranged so as to face the image holding material when a voltage 1000 V is applied to the transfer member to a resistance value when a voltage 500 V is applied is set to (0.5≦ratio≦0.89). Likewise, a resistance value ratio of a resistance value when 2000 V is applied to that when 1000 V is applied is set to (0.3≦ratio≦0.88). Since a just enough transfer current can be optimally generated, image quality can be improved and an image forming apparatus which does not need a large-capacity power source and an elastic roller are provided.

17 Claims, 6 Drawing Sheets

IMAGE FORMING APPARATUS AND ELASTIC ROLLER

BACKGROUND OF THE INVENTION

1. Field of the Invention

The invention relates to an image forming apparatus and an elastic roller.

2. Related Background Art

Hitherto, in image forming apparatuses such as printer of an electrophotographic system, copying apparatus, facsimile apparatus, and the like, a surface of a photosensitive drum is uniformly and evenly charged by a charging roller and exposed by an exposing apparatus, an electrostatic latent image is formed onto the surface, the electrostatic latent image is developed by a developing roller, and a toner image is formed. The toner image is transferred onto a print medium by a transfer roller, the transferred toner image is fixed by a fixing apparatus, and an image is formed (for example, refer to JP-A-9-212012).

The transfer of the toner image is executed in a nip portion which is formed between the photosensitive drum and the transfer roller. For this purpose, a potential difference is formed between the photosensitive drum and the transfer roller and toner on the photosensitive drum is electrostatically moved onto the print medium by the potential difference. Therefore, to improve image quality, it is important to move the just enough toner on the photosensitive drum onto the print medium.

That is, if the potential difference is too large, the transfer becomes excessive, the toner on the photosensitive drum is moved at a position just before the position on an upstream side of the nip portion in the conveying direction of the print medium and defective printing such as what is called dust printing occurs. On the contrary, if the potential difference is too small, the transfer is insufficient, the toner remains on the downstream side of the nip portion in the rotating direction of the photosensitive drum, and defective printing such as hazy printing occurs.

Therefore, to enable an ideal transfer voltage to be applied, just before the print medium reaches the nip portion, a small potential difference (for example, about 1 kV) which does not damage the photosensitive drum is applied as a pre-voltage to an interval between the transfer roller and the photosensitive drum, and a current which is generated in association with the applied potential difference is read out. A resistance value of the transfer roller is calculated on the basis of the read-out current and fed back, thereby calculating an optimum transfer voltage (for example, 5000 V) with reference to a control table which has previously been formed.

The transfer roller is constructed by an axis made of a metal and an elastic layer formed around the axis. It is ideal that a resistance value between the axis and the surface of the transfer roller is set to a value within a range from $10^7$ to $10^9\Omega$. The elastic layer is made of a foaming material using urethane, NBR, EPDM, silicone, or the like as a base material. Since each of the above materials inherently has insulation performance, the semiconductive roller whose resistance value has a proper value is molded by adding an electron conductive material such as carbon black, conductive polymer, metal filler, or the like or an ion conductive material according to an electrolyte into each of the above materials.

In the semiconductive roller, as methods of the electric conduction in the elastic layer, there are electron conduction by an electron conductive material and ion conduction by an ion conductive material. Electrical characteristics of the electron conduction and the ion conduction can be classified as shown in the Table 1. The motion of electrons, ions, and the like can be explained in accordance with a microscopic physical law and statistical law.

TABLE 1

| | Electrical characteristics |
|---|---|
| Electron conduction | The resistance value depends largely (exponentially) on transfer voltage<br>The resistance value is constant without depending on the temperature and humidity |
| Ion conduction | The transfer current is directly proportional to the transfer voltage (the resistance value is constant without depending on the transfer voltage)<br>The resistance value largely depends on temperature and humidity |

That is, in the electron conduction, although a resistance value depends largely (exponentially) on a transfer voltage, it is constant without depending on the temperature and the humidity. In the ion conduction, a generated transfer current is directly proportional to the transfer voltage (a resistance value is constant without depending on the voltage) and the resistance value depends largely on the temperature and the humidity.

Therefore, in the image forming apparatus, a transfer control program is adjusted in consideration of the electrical characteristics shown in Table 1.

FIG. 2 is a graph showing a relation between the transfer voltage and the transfer current in the conventional transfer roller. FIG. 3 is a graph showing a relation between the transfer voltage and a voltage margin in the conventional transfer roller. FIG. 4 is a graph showing a change in resistance value in association with changes in temperature and humidity in the conventional transfer roller. In FIG. 2, an axis of abscissa indicates the transfer voltage which is applied to the transfer roller and an axis of ordinate indicates the transfer current flowing in the transfer roller. In FIG. 3, an axis of abscissa indicates the transfer voltage and an axis of ordinate indicates the voltage margin. In FIG. 4, an axis of abscissa indicates states of environmental degrees of the temperature and the humidity and an axis of ordinate indicates a ratio of the resistance value at the time when the transfer roller is held in an environment of a high temperature and a high humidity and a ratio of the resistance value at the time when the transfer roller is held in an environment of a low temperature and a low humidity on the assumption that the resistance value which is obtained when the transfer roller is held in an environment of the normal temperature and the normal humidity is set to 1.00.

In FIG. 2, L1 denotes a line showing a relation between the transfer voltage and the transfer current in the electron conduction and L2 indicates a line showing a relation between the transfer voltage and the transfer current in the ion conduction, respectively. In FIG. 3, L3 denotes a line showing a relation between the transfer voltage and the voltage margin in the electron conduction and L4 indicates a line showing a relation between the transfer voltage and the voltage margin in the ion conduction, respectively.

In the electron conduction, since the transfer current is expressed by an exponential function of the transfer voltage as shown by the line L1, it is necessary to set the transfer voltage into an extremely narrow range in order to generate a predetermined transfer current. For example, if it is intended to generate the transfer current of 25±5 μA, it is sufficient to set the transfer voltage into a range from 1100 to 1600 V in the ion conduction, while it is necessary to set the transfer voltage into a range from 1000 to 1100 V in the electron conduction. In the electron conduction, since the resistance value depends largely on the transfer voltage, the voltage margin at the time when the transfer voltage is changed changes largely as shown by the line L3. On the other hand, the resistance value does not depend on the transfer voltage in the ion conduction. Therefore, the voltage margin at the time when the transfer voltage is changed is almost constant as shown by the line L4. The voltage margin shows a change μA/V in transfer current to the change in transfer voltage.

Since the resistance value of the transfer roller has a variation in the circumferential direction, for example, if the current deviated from an average value in the circumferential direction is read at a point when a pre-voltage is applied, the transfer voltage is not optimum and the transfer current which is generated is not optimum, either. When the transfer current is large, the transfer becomes excessive and, as mentioned above, the toner on the photosensitive drum is moved at a position just before the position on the upstream side of the nip portion in the conveying direction of the print medium and the defective printing such as what is called dust printing occurs. On the contrary, if the transfer current is small, the transfer is insufficient, the toner remains on the downstream side of the nip portion in the rotating direction of the photosensitive drum, and defective printing such as hazy printing occurs.

The higher a printing speed is, the shorter a transfer time becomes. It is, consequently, necessary to increase the transfer current. However, in the electron conduction, the range of the transfer voltage for optimally and generating the just enough transfer current is further narrowed.

In the ion conduction, the transfer current is expressed by a linear function of the transfer voltage as shown by the line L2 and the resistance value and an electric conductivity do not depend on the voltage. Therefore, since the transfer current can be precisely controlled better than that in the electron conduction, high picture quality can be realized.

However, as shown in FIG. 4, the ratio of the resistance value when the transfer roller is held in the environment of the low temperature and the low humidity to the resistance value when the transfer roller is held in the environment of the normal temperature and the normal humidity is equal to 2.07 in the case of the electron conduction and is equal to 5.23 in the case of the ion conduction. The ratio of the resistance value when the transfer roller is held in the environment of the high temperature and the high humidity to the resistance value when the transfer roller is held in the environment of the normal temperature and the normal humidity is equal to 1.36 in the case of the electron conduction and is equal to 0.10 in the case of the ion conduction, so that the resistance value fluctuates largely in dependence on the temperature and the humidity. In other words, the resistance value decreases in the environment of the high temperature and the high humidity, while the resistance value increases in the environment of the low temperature and the low humidity.

However, in the above conventional image forming apparatus, as shown in Table 2, there are the following problems based on the electric characteristics in both cases of the electron conduction and the ion conduction.

TABLE 2

| | Problems |
|---|---|
| Electron conduction | It is diflicult to predict the transfer voltage and an error is likely to occur in the generated transfer voltage |
| Ion conduction | A power source of a large capacity is necessary to obtain the necessary transfer current at the low temperature and low humidity |

That is, in the case of the electron conduction, it is difficult to predict the transfer voltage and an error is likely to occur in the generated transfer voltage. In the case of the ion conduction, a power source of a large capacity is needed in order to obtain the transfer current necessary in the environment of the low temperature and the low humidity.

Therefore, in order to generate the optimum transfer current in any environment, the transfer voltage according to the resistance value is necessary. Particularly, if the resistance value increases when the transfer roller is held in the environment of the low temperature and the low humidity, it is necessary to raise the transfer voltage.

The higher the printing speed is, the shorter the transfer time becomes. It is, consequently, necessary to increase the transfer current. However, to generate the proper transfer current, it is necessary to raise the transfer voltage. In this case, since it is necessary to raise the transfer voltage in the environment of the low temperature and the low humidity, the power source of the large capacity is needed and costs of the power source rise.

SUMMARY OF THE INVENTION

It is an object of the invention to solve the problems of the foregoing conventional image forming apparatus and to provide an image forming apparatus and an elastic roller, in which a just enough transfer current can be optimally generated and the power source of the large capacity is unnecessary.

According to the present invention, there is provided an image forming apparatus which forms a developer image by making a developer adhere onto an electrostatic latent image formed on an image holding body, further transfers the developer image onto an image forming medium by using a transferring member, then forms an image, wherein the transferring member has a first resistance value when being added by a voltage of 500 V and a second resistance value when being added by a voltage of 1000 V, the ratio of the second and the first resistance values is between 0.5 and 0.89.

in the image forming apparatus, the transferring member may further have a third resistance value when being added by a voltage of 2000 V, the ratio of the third and the second resistance values is between 0.3 and 0.88.

Further, in the image forming apparatus, the transferring member may contain a material with electron conductivity. In this case, the material with electron conductivity includes at least one of carbon black, carbon quality fiber, copper particle, silver particle and nickel.

Further, in the image forming apparatus, the transferring member may contain a material with ion conductivity. In this case, the material with ion conductivity is alkali metal salt.

Further, in the image forming apparatus, the transferring member is added by a power source from 500 voltage to 2000 voltage.

Further, in the image forming apparatus, the transferring member may be a transferring roller.

Further, in the image forming apparatus, the transferring member may be a transfer belt.

Further, according to the present invention, there is provided an image forming apparatus which forms a developer image by making a developer adhere onto an electrostatic latent image formed on an image holding body, further transfers the developer image onto an image forming medium by using a transferring member, then forms an image, wherein the transferring member has a first resistance value when being added by a voltage of 2000 V and a second resistance value when being added by a voltage of 1000 V, the ratio of the second and the first resistance values is between 0.3 and 0.88.

Further, according to the present invention, there is provided an elastic roller constructed by forming an elactic layer around an axis made of a metal, having:

at least one material, wherein the material has a first resistance value when a voltage of 500 V is adding; and a second resistance value when a voltage of 1000 V is adding, the ratio of the second and the first resistance values is between 0.5 and 0.89.

In the elastic roller, the material further has a third resistance value when a voltage of 2000 V is adding, the ratio of the third and the second resistance values is between 0.3 and 0.88.

Further, in the elastic roller, the material may contain a material with electron conductivity. In this case, the material with electron conductivity includes at least one of carbon black, carbon quality fiber, copper particle, silver particle and nickel.

Further, in the elastic roller, the material may contain a material with ion conductivity. In this case, the material with ion conductivity is alkali metal salt.

Further, according to the present invention, there is provided an elastic roller constructed by forming an elactic layer around an axis made of a metal, having:

at least one material, wherein the material has a first resistance value when a voltage of 2000 V is adding; a second resistance value when a voltage of 1000 V is adding, the ratio of the second and the first resistance values between 0.3 and 0.88.

The above and other objects and features of the present invention will become apparent from the following detailed description and the appended claims with reference to the accompanying drawings.

DETAILED DESCRIPTION OF THE PREFERRED EMBODIMENTS

Embodiments of the invention will be described in detail hereinbelow with reference to the drawings.

Figure 5:
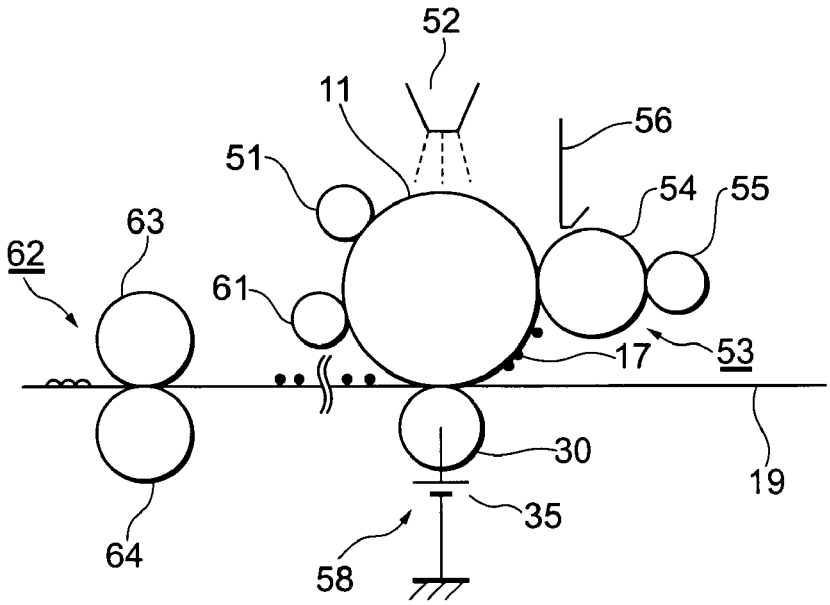
FIG. 5 is a conceptual diagram of an image forming apparatus in the first embodiment of the invention.

FIG. 5 is a conceptual diagram of an image forming apparatus in the first embodiment of the invention.

Figure 6:
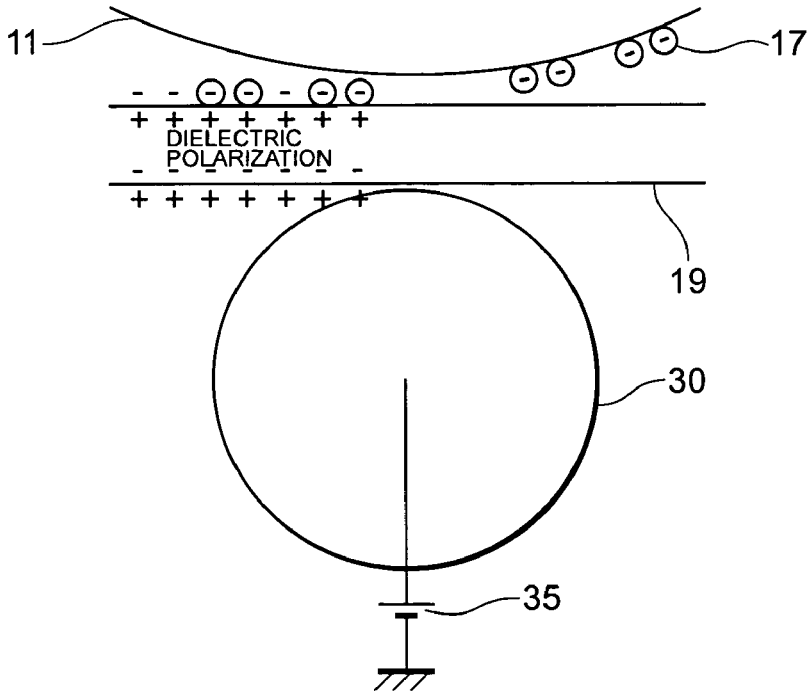
FIG. 6 is a diagram showing the operation which is executed when toner is moved to a print medium by an electrostatic force in a nip portion in the first embodiment of the invention.

FIG. 6 is a diagram showing the operation which is executed when toner is moved to a print medium by an electrostatic force in a nip portion in the first embodiment of the invention.

In the diagram, reference numeral 11 denotes a photosensitive drum as an image holding material which is rotatably arranged; 51 a charging roller as a charging member which is rotatably arranged so as to face the photosensitive drum 11 and uniformly and evenly charges a surface of the photosensitive drum 11; 52 an LED head as an exposing apparatus which is arranged so as to face the photosensitive drum 11, exposes the surface of the photosensitive drum 11, and forms an electrostatic latent image; and 53 a developing apparatus which deposits toner 17 as a developing agent onto the electrostatic latent image and forms a toner image as a developing agent image. The developing apparatus 53 comprises: a developing roller 54 as a developing member which is rotatably arranged so as to face the photosensitive drum 11; a supplying roller 55 as a supplying member which is rotatably arranged in contact with the developing roller 54 and supplies the toner 17 to the developing roller 54; and a developing blade 56 which is arranged in contact with the developing roller 54 and forms a thin layer of the toner 17 onto a surface of the developing roller 54.

Reference numeral 58 denotes a transfer apparatus for transferring the toner image onto a print medium 19 as an image forming medium such as plain paper, OHP sheet, or the like. The transfer apparatus 58 comprises: a transfer roller 30 as a transfer member which is rotatably arranged so as to face the photosensitive drum 11; and a power source 35 for applying a transfer voltage to the transfer roller 30 and supplying a transfer current thereto. Reference numeral 61 denotes a cleaning roller as a cleaning member which is rotatably arranged so as to face the photosensitive drum 11 and used for removing the toner 17 remaining on the surface of the photosensitive drum 11 after the toner image was transferred thereon, and 62 indicates a fixing apparatus for fixing the toner image transferred onto the print medium 19. The fixing apparatus 62 comprises: a heating roller 63 which is rotatably arranged and has therein a heater (not shown) as a heating source; and a pressing roller 64 which is rotatably arranged in contact with the heating roller 63. An elastic roller is constructed by the transfer roller 30.

In the image forming apparatus with the foregoing construction, the surface of the photosensitive drum 11 is uniformly and evenly charged by the charging roller 51 and exposed by the LED head 52 and the electrostatic latent image is formed onto the surface. The electrostatic latent image is developed by the developing apparatus 53 and the toner image is formed. The toner image is transferred onto the print medium 19 by the transfer apparatus 58. The transferred toner image is fixed by the fixing apparatus 62 and an image is formed.

When the print medium 19 is conveyed in the nip portion between the photosensitive drum 11 and the transfer roller 30, a potential difference in a range from hundreds to thousands V is formed between the photosensitive drum 11 and the transfer roller 30 by the power source 35. Since the toner 17 has previously been charged to a negative polarity, the potential difference is formed so that an electric potential of the transfer roller 30 is higher than that of the photosensitive drum 11.

In this case, as shown in FIG. 6, such dielectric polarization that the print surface side of the print medium 19 is set to the positive polarity occurs. When the toner 17 is come into contact with the print surface side of the print medium 19, the toner 17 which has previously been charged to the negative polarity is moved to the print medium 19 by the electrostatic force. In this manner, the toner image is transferred.

The transfer roller 30 will now be described.

Figure 1:
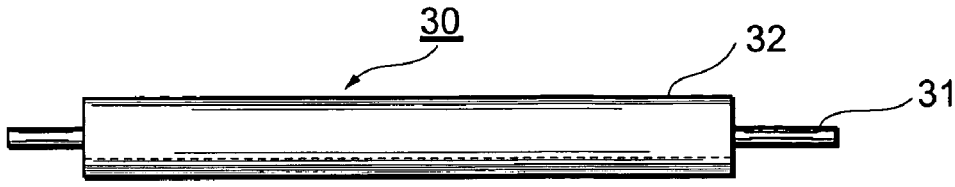
FIG. 1 is a front view of a transfer roller in the first embodiment of the invention.
Figure 2:
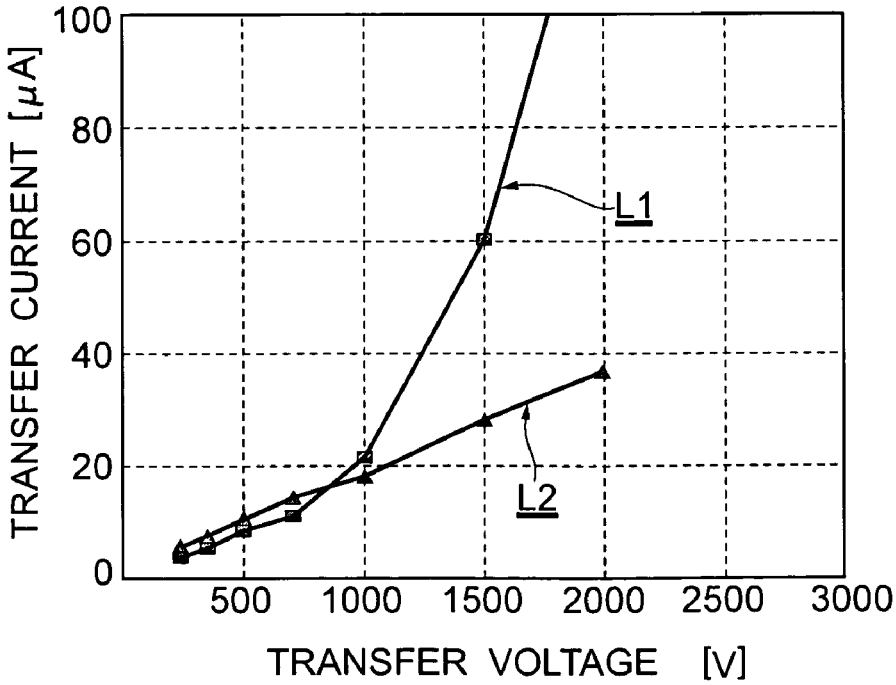
FIG. 2 is a graph showing a relation between a transfer voltage and a transfer current in a conventional transfer roller.
Figure 3:
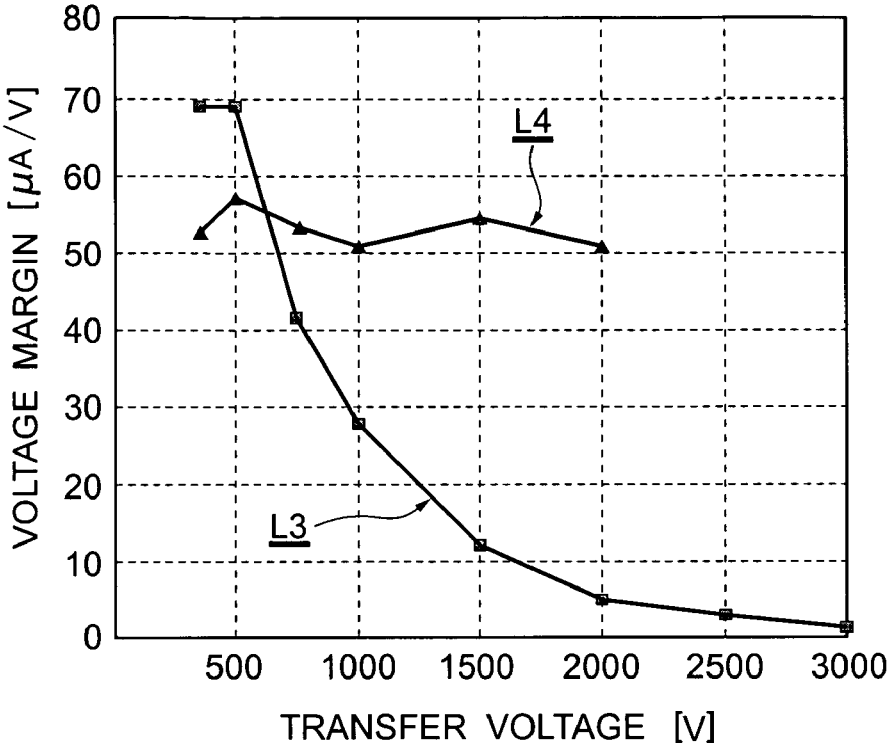
FIG. 3 is a graph showing a relation between the transfer voltage and a voltage margin in the conventional transfer roller.
Figure 4:
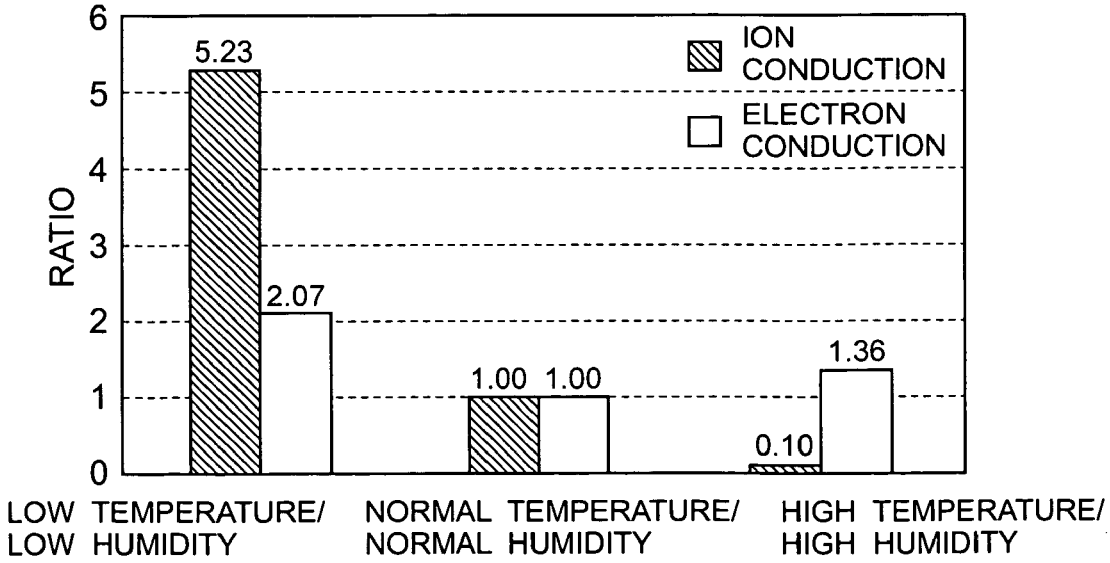
FIG. 4 is a graph showing a change in resistance values in association with changes in temperature and humidity in the conventional transfer roller.

FIG. 1 is a front view of the transfer roller in the first embodiment of the invention.

In the diagram, reference numeral 30 denotes the transfer roller; 31 an axis made of a metal; and 32 an elastic layer formed around the axis 31. The elastic layer 32 is made of a foaming material using urethane, NBR, EPDM, silicone, or the like as a base material. Since each of those materials inherently has insulation performance, by adding an electron conductive material or an ion conductive material to each material, a semiconductive roller whose resistance value is equal to a proper value is molded. As an electron conductive material, carbon black, carbonaceous fiber, copper particle, silver particle, nickel, or the like can be used. As an ion conductive material, alkali metal salt such as sodium salt, potassium salt, lithium salt, or the like, for example, perhalogen chlorine oxygen acid salt, lithium perchlorate, or the like can be used.

Subsequently, upon manufacturing the transfer roller 30, rollers (1 to 5) are manufactured by changing a ratio of addition of the electron conductive material and the ion conductive material.

The roller (1) is manufactured by a method whereby a 7.5 weight-part compound obtained by condensating lithium perchlorate into ethyleneglycol, 10 weight-part titanium oxide whisker, 0.5 weight-part carbon black of a large grain diameter, and 10 weight-part zinc oxide are added to 100 weight-part silicone rubber (dimethylsilicone polymer having a bridge point (vinyl radical)) as a base material. In this case, linearity is equal to 0.95 and a resistance value of the roller (1) is equal to $1.00\times10^{7}\Omega$.

The roller (2) is manufactured by a method whereby a 7.5 weight-part compound obtained by condensating lithium perchlorate into ethyleneglycol, 10 weight-part titanium oxide whisker, 3 weight-part carbon black of a large grain diameter, and 10 weight-part zinc oxide are added to 100 weight-part silicone rubber as a base material. In this case, linearity is equal to 0.8 and a resistance value of the roller (2) is equal to $4.00\times10^{7}\Omega$.

The roller (3) is manufactured by a method whereby a 5 weight-part compound obtained by condensating lithium perchlorate into ethyleneglycol, 10 weight-part titanium oxide whisker, 3 weight-part carbon black of a large grain diameter, and 10 weight-part zinc oxide are added to 100 weight-part silicone rubber as a base material. In this case, linearity is equal to 0.65 and a resistance value of the roller (3) is equal to $1.00\times10^{8}\Omega$.

The roller (4) is manufactured by a method whereby a 4 weight-part compound obtained by condensating lithium perchlorate into ethyleneglycol, 10 weight-part titanium oxide whisker, 3 weight-part carbon black of a large grain diameter, and 10 weight-part zinc oxide are added to 100 weight-part silicone rubber as a base material. In this case, linearity is equal to 0.45 and a resistance value of the roller (4) is equal to $3.00\times10^{8}\Omega$.

The roller (5) is manufactured by a method whereby a 2 weight-part compound obtained by condensating lithium perchlorate into ethyleneglycol, 10 weight-part titanium oxide whisker, 60 weight-part carbon black of a large grain diameter, and 10 weight-part zinc oxide are added to 100 weight-part silicone rubber as a base material. In this case, linearity is equal to 0.3 and a resistance value of the roller (5) is equal to $3.00\times10^{8}\Omega$.

Electrical characteristics of the rollers (1 to 5) mentioned above will now be described.

Figure 7:
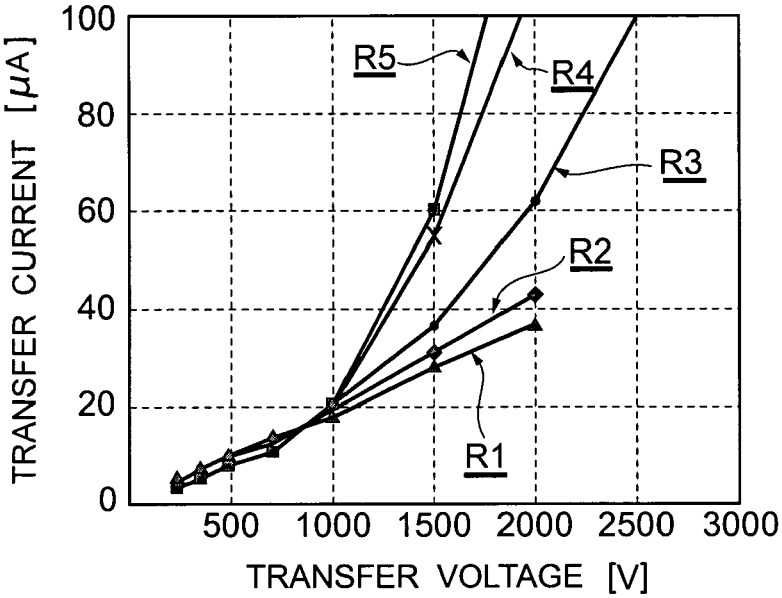
FIG. 7 is a graph showing a relation between a transfer voltage and a transfer current of the transfer roller in the first embodiment of the invention.

FIG. 7 is a graph showing a relation between the transfer voltage and the transfer current of the transfer roller in the first embodiment of the invention. In the diagram, an axis of abscissa indicates the transfer voltage and an axis of ordinate shows the transfer current.

In the diagram, R1 to R5 denote lines showing the relations between the transfer voltages which are applied to the rollers (1 to 5) and the transfer currents which are supplied to the rollers (1 to 5), respectively. It will be also understood from the lines R1 to R5 that the values of the linearity of the rollers (1 to 5) decrease in this order.

In the embodiment, in a range 500 to 2000 V of the voltage which is used in the image forming apparatus, the transfer currents and the resistance values at the time when the transfer voltages of 500, 1000, and 2000 V are applied to the rollers (1 to 5) are as shown in Table 3.

TABLE 3

| Transfer voltage | | Roller 1 | Roller 2 | Roller 3 | Roller 4 | Roller 5 |
|---|---|---|---|---|---|---|
| 500V | Transfer current μA | 8.9 | 8.5 | 8.2 | 5.5 | 5.5 |
| | Resistance value Ω | $5.62\times10^{7}$ | $5.88\times10^{7}$ | $6.10\times10^{7}$ | $9.09\times10^{7}$ | $9.09\times10^{7}$ |
| 1000V | Transfer current μA | 18 | 19 | 20 | 22 | 22.5 |
| | Resistance value Ω | $5.56\times10^{7}$ | $5.26\times10^{7}$ | $5.00\times10^{7}$ | $4.55\times10^{7}$ | $4.44\times10^{7}$ |
| 2000V | Transfer current μA | 36.5 | 43 | 62.5 | 147 | 161 |

TABLE 3-continued

| Transfer voltage | Roller 1 | Roller 2 | Roller 3 | Roller 4 | Roller 5 |
|---|---|---|---|---|---|
| Resistance value Ω | $5.48 \times 10^7$ | $4.65 \times 10^7$ | $3.20 \times 10^7$ | $1.36 \times 10^7$ | $1.24 \times 10^7$ |

A measuring apparatus for measuring the resistance values will now be described.

Figure 8:
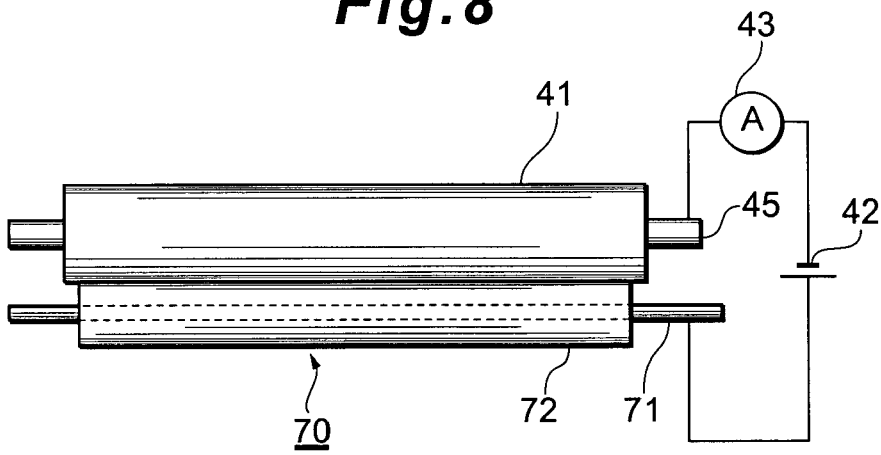
FIG. 8 is a diagram showing a measuring apparatus of resistance values in the first embodiment of the invention.

FIG. 8 is a diagram showing the measuring apparatus of the resistance values in the first embodiment of the invention.

In the diagram, reference numeral 70 denotes a roller (rollers 1 to 5); 71 an axis made of a metal; 72 an elastic layer formed around the axis 71; 41 a cylindrical member made of a metal; 42 a power source for applying the voltages of 500, 1000, and 2000 V as transfer voltages across the transfer roller 30 (FIG. 1) and the cylindrical member 41; and 43 an ammeter (A) for measuring currents flowing as a transfer current from the transfer roller 30 into the cylindrical member 41 when the transfer voltages of 500, 1000, and 2000 V are applied. A depression amount nip of 0.4 mm is formed between the roller 70 and the cylindrical member 41. Reference numeral 45 denotes an axis made of a metal.

Table 4 shows a first resistance value ratio (1000 V/500 V) and a second resistance value ratio (2000 V/1000 V). That is, the first resistance value ratio shows a ratio of the resistance value at the time when the transfer voltage of 1000 V is applied to each of the rollers (1 to 5) shown in Table 3 to the resistance value at the time when the transfer voltage of 500 V is applied, and the second resistance value ratio shows a ratio of the resistance value at the time when the transfer voltage of 2000 V is applied to each of the rollers (1 to 5) to the resistance value at the time when the transfer voltage of 1000 V is applied, respectively.

TABLE 4

| | Roller 1 | Roller 2 | Roller 3 | Roller 4 | Roller 5 |
|---|---|---|---|---|---|
| 1000V/500V | 0.99 | 0.89 | 0.82 | 0.50 | 0.49 |
| 2000V/1000V | 0.99 | 0.88 | 0.64 | 0.30 | 0.28 |

From Table 4, it is possible to recognize an influence which is exerted on the resistance values when the transfer voltage is changed.

To measure the resistance values, another measuring apparatus can be used in place of the measuring apparatus in FIG. 8. Component elements having the same structures as those in FIG. 8 are designated by the same reference numerals and their detailed description is omitted.

Figure 9:
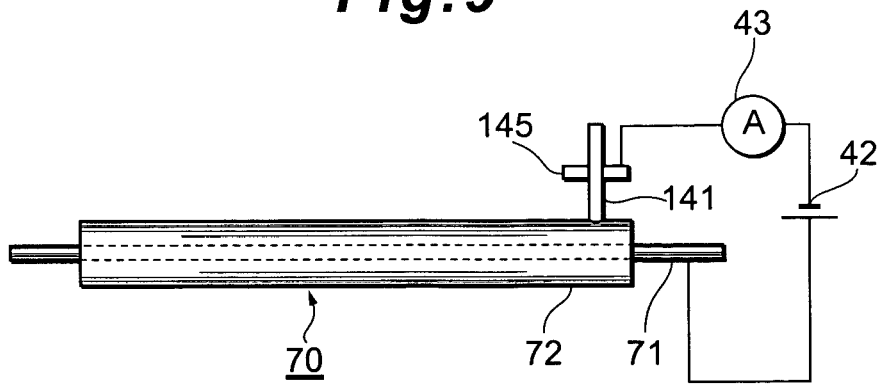
FIG. 9 is a diagram showing another measuring apparatus of the resistance values in the first embodiment of the invention.

FIG. 9 is a diagram showing another measuring apparatus of the resistance values in the first embodiment of the invention.

In this case, reference numeral 141 denotes a bearing made of a metal which is rotatably arranged and 145 indicates an axis made of a metal for supporting the bearing 141. The bearing 141 is pressed onto a surface of the elastic layer 72 in a predetermined position in the axial direction of the roller 70.

Each of the above ratios can be calculated on the basis of a width of roller 70 and a width of bearing 141.

Voltage margins in the rollers (1 to 5) will now be described.

Figure 10:
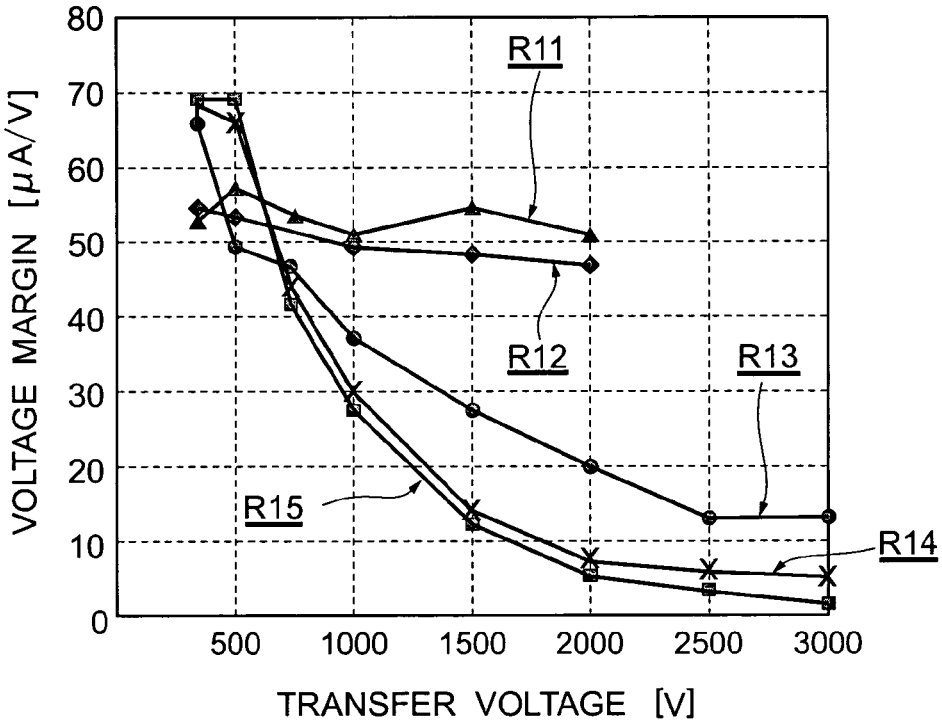
FIG. 10 is a graph showing a relation between the transfer voltage and a voltage margin in the first embodiment of the invention.

FIG. 10 is a graph showing a relation between the transfer voltage and the voltage margin in the first embodiment of the invention. In the diagram, an axis of abscissa denotes the transfer voltage and an axis of ordinate indicates the voltage margin.

In the diagram, R11 to R15 denote lines showing the voltage margins at the time when the transfer voltage is changed in the rollers (1 to 5). It will be understood that the resistance values of the rollers (1 to 5) depend on the transfer voltage and the voltage margins at the time when the transfer voltage is changed decrease in order.

Subsequently, the voltages which are necessary for changing the transfer current by 1 μA at the time when the transfer voltages of 500, 1000, and 2000 V are applied to the rollers (1 to 5) are shown in Table 5.

TABLE 5

| Voltage | Roller 1 | Roller 2 | Roller 3 | Roller 4 | Roller 5 |
|---|---|---|---|---|---|
| 500V | 58 | 55 | 49 | 68 | 70 |
| 1000V | 52 | 50 | 38 | 30 | 28 |
| 2000V | 52 | 47 | 20 | 7 | 6 |

For example, to change the transfer current by 1 μA at the time when the transfer voltage of 2000 V is applied, it is necessary to change the transfer voltage by 52 V, 47 V, 20 V, 7 V, and 6V in the rollers (1 to 5), respectively.

In the embodiment, however, when the image is formed by using the image forming apparatus, it is necessary to control by changing the transfer current at a pitch of 1 μA in order to improve the image quality. Therefore, if it is intended to use the rollers (1 to 5) as a transfer roller 30 (FIG. 1) and form the image by applying the transfer voltage of 2000 V to the rollers (1 to 5), the transfer voltage is changed every voltage of 52 V, 47 V, 20 V, 7 V, and 6V. However, in the case of generating the transfer voltage of 2000 V, a change amount of the transfer voltage of 6V or less is within a range of variation and cannot be discriminated. Therefore, in the case of forming the image by using the image forming apparatus, it is necessary to use a control table formed by the change amounts larger than 6V.

Therefore, it is unpreferable to use the roller (5) but it is desirable to use the rollers (1 to 4). Accordingly, from the electrical characteristics of Table 4, in order to control the transfer voltage, a resistance value ratio γ1 is set to $$\gamma 1 \geqq 0.5$$

and a resistance value ratio γ2 is set to $$\gamma 2 \geqq 0.3$$

where,

γ1: Resistance value ratio of the resistance value at the time when the transfer voltage of 1000 V is applied to the resistance value at the time when the transfer voltage of 500 V is applied γ2: Resistance value ratio of the resistance value at the time when the transfer voltage of 2000 V is applied to the resistance value at the time when the transfer voltage of 1000 V is applied Therefore, since the control can be made by changing the transfer voltage by a change amount larger than 6 V and changing the transfer current at a pitch of 1 μA and the just enough transfer current can be generated, the image quality can be improved.

Relations among the resistance value, the temperature, and the humidity will now be described.

Figure 11:
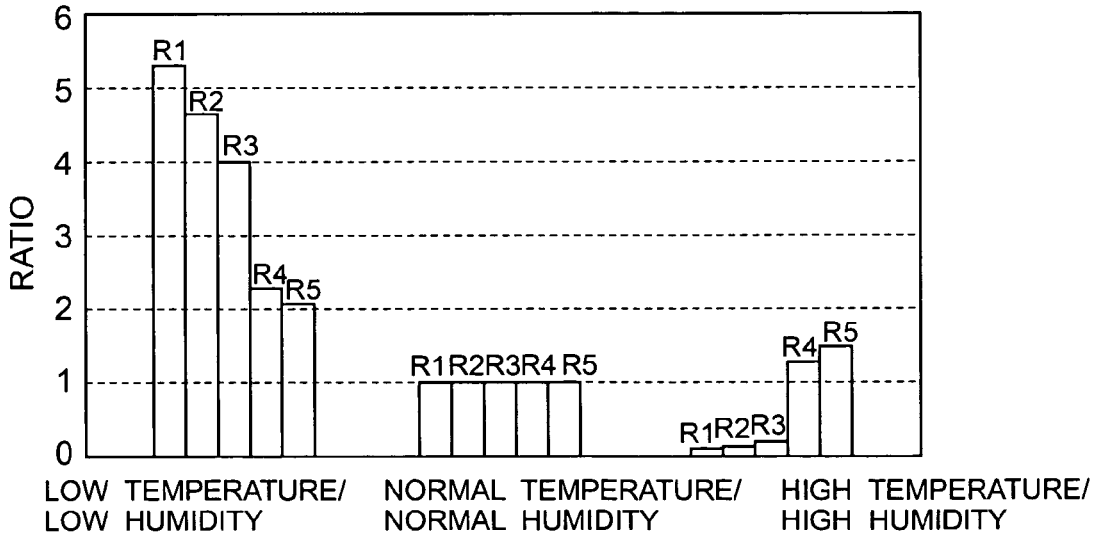
FIG. 11 is a diagram showing a change in resistance value of the roller in association with changes in temperature and humidity in the first embodiment of the invention.

FIG. 11 is a diagram showing a change in resistance value of the roller in association with changes in temperature and humidity in the first embodiment of the invention. In the diagram, an axis of abscissa indicates states of the temperature and the humidity and an axis of ordinate indicates the ratio of the resistance value at the time when the roller is held in an environment of the low temperature and the low humidity (L/L: 10° C., 20%) and the ratio of the resistance value at the time when the roller is held in an environment of the high temperature and the high humidity (H/H: 28° C., 80%) in the case where the resistance value when the roller is held in an environment of the normal temperature and the normal humidity (N/N: 20° C., 50%) is assumed to be 1.00, respectively.

As shown in the diagram, it will be understood that the resistance values of the rollers (1 to 5) increase in the environment of the low temperature and the low humidity and, moreover, the resistance values of the rollers (1 to 5) decrease in order.

Change ratios of the resistance values of the rollers (1 to 5) in the environmental conditions of (the low temperature and the low humidity), (the normal temperature and the normal humidity), and (the high temperature and the high humidity) are shown in Table 6.

TABLE 6

| Environmental conditions | Roller 1 | Roller 2 | Roller 3 | Roller 4 | Roller 5 |
|---|---|---|---|---|---|
| (L/L)/(N/N) | 5.23 | 4.7 | 3.95 | 2.2 | 2.07 |
| (N/N) = 1 | 1 | 1 | 1 | 1 | 1 |
| (H/H)/(N/N) | 0.1 | 0.11 | 0.13 | 1.2 | 1.36 |

In Table 6, (L/L)/(N/N) indicates a ratio of the resistance value at the time when the roller is held in the environment of the low temperature and the low humidity in the case where the resistance value at the time when the roller is held in the environment of the normal temperature and the normal humidity is assumed to be 1.00, and (H/H)/(N/N) indicates a ratio of the resistance value at the time when the roller is held in the environment of the high temperature and the high humidity in the case where the resistance value at the time when the roller is held in the environment of the normal temperature and the normal humidity is assumed to be 1.00.

In this case, the resistance values of the rollers (1 to 5) are assumed to be the maximum values among the resistance values of the rollers (1 to 5) shown in Table 3 (hereinafter, such a maximum value is referred to as "maximum resistance value"), that is, $5.62\times10^7$, $5.88\times10^7$, $6.10\times10^7$, $9.09\times10^7$, and $9.09\times10^7$ and results of calculations of the resistance values of the rollers (1 to 5) in the environmental conditions of (the low temperature and the low humidity), (the normal temperature and the normal humidity), and (the high temperature and the high humidity) are shown in Table 7.

TABLE 7

| Environmental conditions | Roller 1 | Roller 2 | Roller 3 | Roller 4 | Roller 5 |
|---|---|---|---|---|---|
| Low temperature/low humidity | $2.94\times10^8$ | $2.76\times10^8$ | $2.41\times10^8$ | $2.00\times10^8$ | $1.88\times10^8$ |
| Normal temperature/normal humidity | $5.62\times10^7$ | $5.88\times10^7$ | $6.10\times10^7$ | $9.09\times10^7$ | $9.09\times10^7$ |
| High temperature/high humidity | $5.62\times10^6$ | $6.47\times10^6$ | $7.93\times10^6$ | $1.09\times10^8$ | $1.24\times10^8$ |

In the embodiment, in the case where the image is formed by using the image forming apparatus, in order to improve the image quality in the environment of the low temperature and the low humidity, it is necessary to supply the transfer current of 10 μA or more. However, to prevent an increase in costs of the power source 35 of the transfer apparatus 58 (FIG. 5) of the image forming apparatus, it is preferable that the transfer voltage which is generated by the power source 35 is set to 5000 V or less. In this case, it is necessary that the resistance value in the environment of the low temperature and the low humidity is set to $5\times10^8\Omega$ or less.

The resistance value of the transfer roller 30 increases by an aging change separately from the environment according to the temperature and the humidity. For example, it has been known by experiments that the resistance value of the transfer roller 30 at a point of time when the life of the image forming apparatus expires is 1.8 times as large as that upon manufacturing. Therefore, the resistance value of the transfer roller 30 upon manufacturing in the environment of the low temperature and the low humidity has to be set to $2.77\times10^8\Omega$ or less.

Therefore, referring to Table 7, to obtain the resistance value of $2.77\times10^8\Omega$ or less in the environment of the low temperature and the low humidity, it is unpreferable to use the roller 1 but it is desirable to use the rollers 2 to 5.

According to the electrical characteristics of Table 4, in order to control the transfer voltage in consideration of the aging change in the environment of the low temperature and the low humidity, it is necessary to set the resistance value ratio γ1 to $$\gamma1\leqq0.89$$

and set the resistance value ratio γ2 to $$\gamma2\leqq0.88$$

Therefore, in order to satisfy the voltage margin, the environment of the low temperature and the low humidity, and the aging change, if the resistance value ratio γ1 is set to $$0.5\leqq\gamma1\leqq0.89$$

and the resistance value ratio γ2 is set to $$0.3\leqq\gamma2\leqq0.88,$$

the transfer current of 10 μA or more can be supplied in the environment of the low temperature and the low humidity and the just enough transfer current can be optimally generated. Therefore, the image quality can be improved. Since the transfer voltage which is generated by the power source 35 can be set to 5000 V or less, the power source 35 of a large capacity is unnecessary and the costs of the power source 35 can be reduced.

If it is intended to set the resistance value ratios γ1 and γ2 into the above-mentioned range, since an electron conductive material and an ion conductive material are expensive, the costs of the transfer roller 30 rise. Therefore, particularly, in the color printer of the electrophotographic system of a high speed and high resolution, the invention is suitable to the case where the transfer roller 30 is used as a secondary transfer roller in the case where it is necessary to transfer the toner image of the thick layer or is used as a transfer roller in the case where it is intended to preferably transfer the toner image also onto the back surface of the print medium 19 whose resistance value is large.

The nip amount showing a contact amount of the nip portion can be increased in order to form the image of high resolution or a coating layer can be formed onto the elastic layer 32 (FIG. 1) in order to smoothen the surface of the transfer roller 30.

The second embodiment will now be described.

Figure 12:
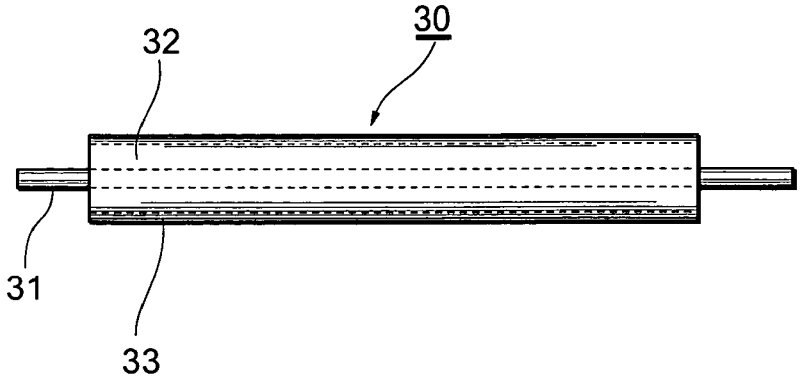
FIG. 12 is a front view of a transfer roller in the second embodiment of the invention.
Figure 13:
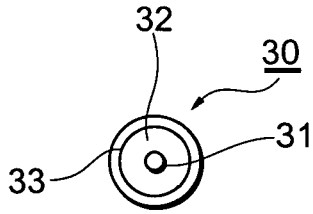
FIG. 13 is a cross sectional view of the transfer roller in the second embodiment of the invention.

FIG. 12 is a front view of a transfer roller in the second embodiment of the invention. FIG. 13 is a cross sectional view of the transfer roller in the second embodiment of the invention.

In the diagram, reference numeral 30 denotes the transfer roller as a transfer member; 31 the axis made of a metal; 32 the elastic layer made of a foaming material using urethane, NBR, EPDM, silicone, or the like as a base material; and 33 a coating layer made of a resin tube of nylon, PFA, PVdF, or the like formed on the elastic layer 32. In place of the resin tube, a rubber-like skin layer can be also formed as a coating layer 33. A semiconductor layer is constructed by the elastic layer 32 and the coating layer 33.

In this case, while the elasticity of the transfer roller 30 is assured by the foaming material constructing the elastic layer 32, the surface of the transfer roller 30 can be smoothed by the coating layer 33.

The third embodiment will now be described.

In this case, silicone is used as a base material so that the resistance value of the transfer roller 30 (FIG. 12) as a transfer member is stable even if the environmental conditions change. Although urethane is generally used as a base material of the semiconductive roller, it is preferable to use silicone which is not easily influenced by the moisture in the environmental conditions in consideration of hydrophobic of the base material itself.

Hitherto, in the case of forming the elastic layer 32 by silicone mentioned above, heat treatments of two times at a high temperature comprising the primary vulcanization and the secondary vulcanization are executed. The primary vulcanization is a heat treatment which is executed for foaming and bridging at a higher temperature and for a shorter time than those in the secondary vulcanization. In consideration of such a phenomenon that silicone is deteriorated by heat, an upper limit of the temperature is set to 200° C. and a vulcanization time is set to 6 hours.

However, compatibility between silicone and a high polymer electrolyte is low. In particular, in the environment of the high temperature and the high humidity, silicone and low molecules of the high polymer electrolyte ooze from the surface of the transfer roller 30 and dirty the photosensitive drum 11 (FIG. 5) as an image holding material. Since the transfer roller 30 and the photosensitive drum 11 are always used in a contact state, if the image forming apparatus is left for a long time in the environment of the high temperature and the high humidity, a chemical reaction occurs in the nip portion between the photosensitive drum 11 and the transfer roller 30 due to the high polymer electrolyte included in the transfer roller 30, thereby causing drum pollution in which stripes are formed on the image at a pitch of the photosensitive drum 11. Particularly, when the image forming apparatus is transported abroad, there is a possibility that the apparatus is left in the environmental conditions which are severer than the environmental conditions which are presumed when the image forming apparatus is used, for example, in the environment of a temperature of about 50° C. and a humidity of about 90%.

When the apparatus is left in the environment of the high humidity of about 90%, since the foaming material made of silicone contains many water molecules, the high polymer electrolyte having the polarity is surrounded by the water molecules and a degree of freedom of the electrolyte in silicone increases. When the apparatus is left in the environment of the high temperature of about 50° C., kinetic energy of each water molecule increases, thereby promoting easiness of motion of the water molecules.

The high polymer electrolyte which has an affinity with the water molecules more than silicone is not blended in silicone but is adhered onto the photosensitive drum 11 which is in contact with the transfer roller 30. Thus, since the high polymer electrolyte adhered onto the photosensitive drum 11 shields the exposure which is made by the LED head 52 as an exposing apparatus, the surface potential of the photosensitive drum 11 does not change. The toner 17 as a developing agent is not adhered in the development, so that a defective printing such as hazy printing occurs. Although there is a case where the drum pollution is eliminated by printing a few copies, when a degree of the drum pollution is high, there is a risk that the drum pollution is penetrated into a photosensitive layer of the photosensitive drum 11 and functions of a charge transfer layer, a charge generating layer, and the like are lost.

To solve such a problem, therefore, in the embodiment, in the case where the semiconductive roller uses silicone as a base material and contains the high polymer electrolyte which performs at least the ion conduction, the temperature of the secondary vulcanization is set to 230° C. and the time of the secondary vulcanization is set to 6 hours. After completion of such a heat treatment, the outer peripheral surface of the roller is polished and finished into predetermined dimensions.

When the temperature of the secondary vulcanization is set to 230° C., the resistance value of the transfer roller 30 increases as shown in Table 8.

TABLE 8

| | Temperature of the secondary vulcanization ° C. | |
|---|---|---|
| | 200 | 230 |
| 200° C. is used as a reference | 1.00 | 1.46 |

Subsequently, when the transfer roller 30 is left in the environment of a temperature of about 80° C. and a humidity of about 90% for a predetermined time, levels at which the photosensitive drum 11 is polluted by the high polymer electrolyte oozed from the transfer roller 30 are compared by performing gray-scale printing. According to the gray-scale printing, the defective printing such as hazy printing can be recognized more easily than the case of the ordinary character printing.

Subsequently, Table 9 shows a print result which is obtained when the time of the secondary vulcanization is set to the same time of 6 hours as the conventional one and the temperature of the secondary vulcanization is changed in a range from 200 to 230° C. and a comparison result of a soluble amount which is obtained when the temperature of the secondary vulcanization is changed in the range from 200 to 230° C. and methanol is extracted from the elastic layer 32 of each of the formed transfer rollers 30.

TABLE 9

| | Temperature of the secondary vulcanization ° C. | | | |
|---|---|---|---|---|
| | 200 | 210 | 220 | 230 |
| Soluble amount % | 2.1 | 2.0 | 1.8 | 1.4 |
| Print hazy level | X | X | Δ | ○ |

As shown in Table 9, the higher the temperature of the secondary vulcanization is, the stronger the coupling between silicone and the high polymer electrolyte is. When the temperature of the secondary vulcanization is set to 230° C., the image quality is high in both of the gray-scale printing and the character printing. When the temperature of the secondary vulcanization is set to 220° C., although the image quality is high in the character printing, the defective printing such as hazy printing occurs in the gray-scale printing. If there is no need to provide the high image quality as in the case of using plain paper as a print medium 19 serving as an image forming medium, in the case of facsimile printing, or the like, the transfer roller 30 can be sufficiently used.

In this case, since the time of the secondary vulcanization is equal to the same time of 6 hours as the conventional one, the working time is not long and the costs of the transfer roller 30 can be reduced.

In the third embodiment mentioned above, on the other hand, the occurrence of the drum pollution can be suppressed by raising the temperature of the secondary vulcanization. However, as shown in Table 8, the resistance value increases, the hardness of the transfer roller 30 rises, and the base material itself constructing the elastic layer 32 deteriorates at a high temperature.

Therefore, explanation will now be made with respect to the fourth embodiment of the invention which can prevent such a problem that the resistance value increases, the hardness of the transfer roller 30 rises, and the base material itself constructing the elastic layer 32 deteriorates at a high temperature and can suppress the occurrence of drum pollution.

Figure 14:
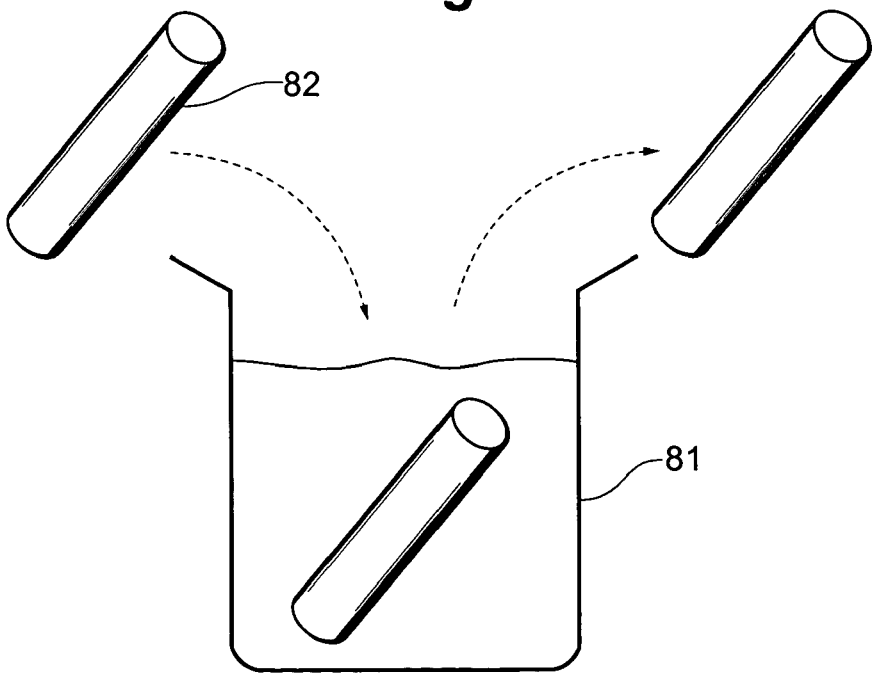
FIG. 14 is a diagram showing a manufacturing method of a transfer roller in the fourth embodiment of the invention.

FIG. 14 is a diagram showing a manufacturing method of a transfer roller in the fourth embodiment of the invention.

In the diagram, reference numeral 81 denotes a dipping vessel enclosing isopropyl alcohol (IPA) and 82 indicates a tube made of a semiconductive thermosetting resin PVdF. The tube 82 is dipped into isopropyl alcohol in the dipping vessel 81 for four hours, thereby extracting low molecules. Subsequently, the tube 82 is taken out from the dipping vessel 81 and the elastic layer 32 (FIG. 1) shown in the first embodiment is coated with the tube 82.

Many low molecules which are not fetched, as a complete high molecule, into a molecular chain when the tube 82 is molded, many low molecules which are not strongly coupled with the high molecule even in the state where no electric field is applied, and the like also exist in the tube 82.

However, since each of the low molecules or the like mainly comprises an organic substance and its polarity is large, if the tube 82 is dipped into isopropyl alcohol of a small polarity, each low molecule is easily dissolved into isopropyl alcohol and precipitated. Moreover, unlike the case of executing the heat treatment of a high temperature, since each of the low molecules or the like can be directly dipped and dissolved into isopropyl alcohol, the work is not troublesome.

A relation between the time during which the tube 82 is dipped into isopropyl alcohol and the drum pollution is shown in Table 10. The drum pollution is evaluated by executing the gray-scale printing at resolution of 1200 DPI. The leaving time during which the transfer roller 30 and the photosensitive drum 11 are left in the contact state is set to 72 hours.

TABLE 10

| Time | Drum pollution (left for 72 hours) |
|---|---|
| 1 | X: There is drum pollution |
| 2 | Δ: Although a thin stripe is confirmed, there is no problem on print quality |
| 4 | ○: No stripe can be confirmed |
| 8 | ○: No stripe can be confirmed |
| 16 | ○: No stripe can be confirmed |
| 24 | ○: No stripe can be confirmed |

As will be understood from Table 10, when the tube 82 is dipped into isopropyl alcohol for 4 or more hours and the elastic layer 32 shown in the first embodiment is coated with the tube 82 obtained after the low molecules were extracted, the occurrence of the drum pollution can be suppressed.

Although the transfer roller 30 is used as a transfer member in each of the foregoing embodiments, a transfer belt can be used as a transfer member.

The invention is not limited to the foregoing embodiments but many modifications and variations are possible on the basis of the spirit of the present invention and they are not excluded from the scope of the invention.

As described in detail above, according to the invention, in the image forming apparatus, the developing agent image is formed by adhering the developing agent onto the electrostatic latent image formed on the image holding material, the developing agent image is transferred onto the image forming medium, and the image is formed.

The apparatus has the transfer member arranged so as to face the image holding material.

The resistance value ratio of the resistance value of the transfer member at the time when the voltage of 1000 V is applied to the transfer member to the resistance value of the transfer member at the time when the voltage of 500 V is applied is set to a value which is equal to or larger than 0.5 and is equal to or less than 0.89. The resistance value ratio of the resistance value of the transfer member at the time when the voltage of 2000 V is applied to the transfer member to the resistance value of the transfer member at the time when the voltage of 1000 V is applied is set to a value which is equal to or larger than 0.3 and is equal to or less than 0.88.

In this case, since the just enough transfer current can be optimally generated, the image quality can be improved. The power source of the large capacity is unnecessary and the costs of the power source can be reduced.

What is claimed is:

1. An image forming apparatus which forms a developer image by making a developer adhere onto an electrostatic latent image formed on an image holding body, further transfers the developer image onto an image forming medium by using a transferring member, then forms an image, wherein the transferring member has a first resistance value when being added by a voltage of 500 V, a second resistance value when being added by a voltage of 1000 V, and a ratio of the second resistance value to the first resistance value between 0.5 and 0.89.

2. The image forming apparatus according to claim 1, wherein the transferring member further has a third resistance value when being added by a voltage of 2000 V and a ratio of the third resistance value to the second resistance value between 0.3 and 0.88.

3. The image forming apparatus according to claim 1, wherein the transferring member contains a material with electron conductivity.

4. The image forming apparatus according to claim 3, wherein the material with electron conductivity includes at least one of carbon black, carbon quality fiber, copper particle, silver particle and nickel.

5. The image forming apparatus according to claim 1, wherein the transferring member contains a material with ion conductivity.

6. The image forming apparatus according to claim 5, wherein the material with ion conductivity is alkali metal salt.

7. The image forming apparatus according to claim 1, wherein the transferring member is added by a power source from 500 V to 2000 V.

8. The image forming apparatus according to claim 1, wherein the transferring member is a transferring roller.

9. The image forming apparatus according to claim 1, wherein the transferring member is a transfer belt.

10. An image forming apparatus which forms a developer image by making a developer adhere onto an electrostatic latent image formed on an image holding body, further transfers the developer image onto an image forming medium by using a transferring member, then forms an image, wherein the transferring member has a first resistance value when being added by a voltage of 2000 V, a second resistance value when being added by a voltage of 1000 V, and a ratio of the second resistance value to the first resistance value between 0.3 and 0.88.

11. An elastic roller constructed by forming an elastic layer around an axis made of a metal, having:

at least one material, wherein the material has a first resistance value when a voltage of 500 V is added, a second resistance value when a voltage of 1000 V is added, and a ratio of the second resistance value to the first resistance value between 0.5 and 0.89.

12. The elastic roller according to claim 11, wherein the material further has a third resistance value when a voltage of 2000 V is added, and a ratio of the third resistance value to the second resistance value between 0.3 and 0.88.

13. The elastic roller according to claim 11, wherein the material contains a material with electron conductivity.

14. The elastic roller according to claim 13, wherein the material with electron conductivity includes at least one of carbon black, carbon quality fiber, copper particle, silver particle and nickel.

15. The elastic roller according to claim 11, wherein the material contains a material with ion conductivity.

16. The elastic roller according to claim 15, wherein the material with ion conductivity is alkali metal salt.

17. An elastic roller constructed by forming an elastic layer around an axis made of a metal, having:

at least one material, wherein the material has a first resistance value when a voltage of 2000 V is added, a second resistance value when a voltage of 1000 V is added, and a ratio of the second resistance value to the first resistance value between 0.3 and 0.88.

* * * * *